US010390666B2

(12) United States Patent
Del Duke et al.

(10) Patent No.: US 10,390,666 B2
(45) Date of Patent: Aug. 27, 2019

(54) TOILET SEAT TIGHTENING KIT

(71) Applicant: Ginsey Industries, Inc., Swedesboro, NJ (US)

(72) Inventors: Matthew James Del Duke, Audubon, NJ (US); Christopher Ernest Greco, Sewell, NJ (US)

(73) Assignee: Ginsey Industries, Inc., Swedesboro, NJ (US)

( * ) Notice: Subject to any disclaimer, the term of this patent is extended or adjusted under 35 U.S.C. 154(b) by 292 days.

(21) Appl. No.: 15/284,970

(22) Filed: Oct. 4, 2016

(65) Prior Publication Data

US 2018/0092497 A1 Apr. 5, 2018

(51) Int. Cl.

| | |
|---|---|
| ***A47K 13/26*** | (2006.01) |
| ***A47K 17/00*** | (2006.01) |
| ***B25B 23/00*** | (2006.01) |
| ***B25B 13/48*** | (2006.01) |
| ***B25B 13/50*** | (2006.01) |
| ***B25B 13/04*** | (2006.01) |
| ***B25B 15/02*** | (2006.01) |
| ***B25F 1/00*** | (2006.01) |
| ***B25F 3/00*** | (2006.01) |

(Continued)

(52) U.S. Cl.

CPC ..... *A47K 13/26* (2013.01); *B25B 13/04* (2013.01); *B25B 13/48* (2013.01); *B25B 13/481* (2013.01); *B25B 13/5091* (2013.01); *B25B 15/00* (2013.01); *B25B 15/02* (2013.01); *B25B 23/0085* (2013.01); *B25F 1/00* (2013.01); *B25F 3/00* (2013.01); *A47K 17/00* (2013.01); *B25F 5/00* (2013.01); *Y10T 29/49948* (2015.01); *Y10T 29/5383* (2015.01); *Y10T 29/53796* (2015.01); *Y10T 29/53843* (2015.01)

(58) Field of Classification Search

CPC .... A47K 17/00; A47K 13/26; B25B 23/0085; B25B 13/48; B25B 13/481; B25B 13/04; B25B 15/00; B25B 15/02; Y10T 29/53843; Y10T 29/5383; Y10T 29/53796; Y10T 29/49948; B25F 5/00; B25F 3/00; B25F 1/00

USPC .... 4/240, 234, 236; 411/402, 407, 409, 326, 411/427, 55, 533, 919; 81/124.2, 125.1, 81/467, 176.15; 700/177; 7/138, 165; 29/244, 252, 255; 269/3, 6, 95

See application file for complete search history.

(56) References Cited

U.S. PATENT DOCUMENTS 3,116,527 A * 1/1964 Springer ..... A47K 13/242 24/527
3,452,373 A * 7/1969 Vosbikian ..... B25B 13/06 7/138

(Continued)

*Primary Examiner* — Bayan Salone
(74) *Attorney, Agent, or Firm* — Pepper Hamilton LLP

(57) ABSTRACT

A toilet seat tightening kit is provided that includes a screwdriver, a wrench, and one or more washers. The components of the toilet seat tightening kit can be joined or fitted together to provide a unitary (i.e., single) component for storage. The components can be easily separated for use. The components of the toilet seat tightening kit are used with one or more pairs of a bolt and a nut that are commonly provided with a toilet seat to securely install the toilet seat on a toilet base. In an assembled form, the washers fit over a shaft of the screwdriver, and the shaft of the screwdriver snaps into an interior cavity of the wrench. The interior cavity is sized and shaped to contain the washers and the screwdriver shaft.

18 Claims, 6 Drawing Sheets

(51) Int. Cl.
*B25F 5/00* (2006.01)
*B25B 15/00* (2006.01)

(56) References Cited

U.S. PATENT DOCUMENTS

| | | | | | |
|---|---|---|---|---|---|
| 4,229,999 | A * | 10/1980 | Rottigni | B25B 27/24 | 7/100 |
| 4,866,801 | A * | 9/1989 | Lamar | B25B 9/00 | 7/165 |
| 5,222,851 | A * | 6/1993 | Dickerson | E03D 11/16 | 4/252.1 |
| D385,761 | S | 11/1997 | Nave | | |
| 2012/0266446 | A1 * | 10/2012 | Leibfried | A47K 13/26 | 29/525.02 |

* cited by examiner

TOILET SEAT TIGHTENING KIT

BACKGROUND

To securely fasten a toilet seat to a toilet base, several tools and components are required. One or more pairs (typically two) of a bolt and a nut are commonly provided with a toilet seat to assist in the fastening of the toilet seat to a toilet base. To install the toilet seat on the toilet base, fastening holes of the seat and the base are aligned, a screwdriver is used to tighten a bolt in each hole, and a wrench is used to tighten a nut on a bottom portion of the bolt extending from an underside portion of the toilet base of each hole. Additionally, a washer may be installed with the nut to prevent loosening of the nut.

This document describes an improved toilet seat tightening kit containing the tools needed for installing a toilet seat.

SUMMARY

Embodiments of the present invention provide for a toilet seat tightening kit.

In one embodiment, a toilet seat tightening kit comprises a screwdriver comprising a shaft; one or more washers configured to fit over the shaft of the screwdriver; and a wrench comprising a wrenching portion and a handle extending longitudinally therefrom, wherein at least a portion of the wrench defines an interior cavity with an opening. The screwdriver and the wrench, in an assembled form, are configured to mate with one another by the shaft of the screwdriver fitting into the interior cavity via the opening of the wrench to form a unitary structure.

In another embodiment, in a disassembled form, the screwdriver is configured to tighten a bolt in aligned holes of a toilet seat and a toilet base; and the wrench is configured to tighten a nut on a portion of the bolt protruding from an underside portion of the toilet base so that the washer is tightly positioned between the nut and the underside portion of the toilet base.

In yet another embodiment, a method of tightening a toilet seat is provided. The method comprises: providing a toilet seat tightening kit that comprises a screwdriver comprising a shaft, one or more washers configured to fit over the shaft of the screwdriver, and a wrench comprising a wrenching portion and a handle extending longitudinally therefrom, wherein at least a portion of the wrench defines an interior cavity with an opening, and wherein, in an assembled form, the screwdriver and the wrench are configured to mate with one another by the shaft of the screwdriver fitting into the interior cavity via the opening of the wrench to form a unitary structure; tightening a bolt in aligned holes of a toilet seat and a toilet base with the screwdriver so that a top portion of the bolt is positioned on a topside portion of the toilet seat and the toilet base and a bottom portion of the bolt protrudes from an underside portion of the toilet base; sequentially placing one of the one or more washers and a nut on the bottom portion of the bolt; and tightening the nut with the wrenching portion of the wrench so that the one of the one or more washers is positioned between the nut and the underside portion of the toilet base on the bottom portion of the bolt.

BRIEF DESCRIPTION OF THE DRAWINGS

The foregoing and other aspects of the present invention are best understood from the following detailed description when read in connection with the accompanying drawings.

For the purpose of illustrating the invention, there is shown in the drawings embodiments that are presently preferred, it being understood, however, that the invention is not limited to the specific instrumentalities disclosed. Included in the drawings are the following Figures.

DETAILED DESCRIPTION

Embodiments of the present invention relate to a toilet seat tightening kit in which the components can be joined or fitted together to provide a unitary (i.e., single) component for storage and in which the components can be easily separated for use. The components of the toilet seat tightening kit, according to embodiments provided herein, comprise the items necessary for tightly (i.e., securely) installing a toilet seat to a toilet base. According to embodiments, the components of the toilet seat tightening kit are used with one or more pairs (e.g., two pairs) of a bolt and a nut that are commonly provided with a toilet seat.

Figure 2:
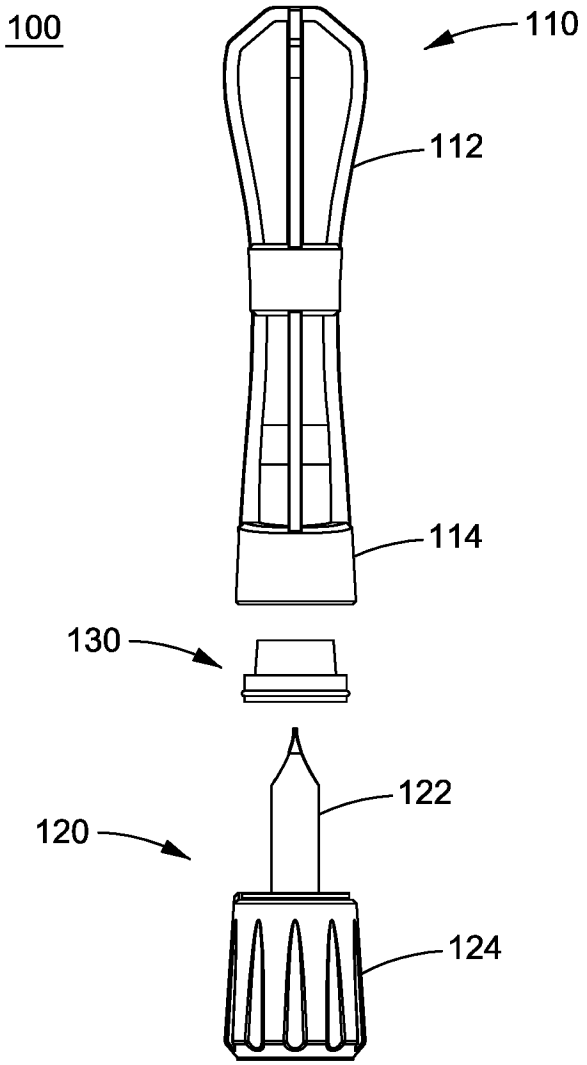
FIG. 2 is a side view of components of a toilet seat tightening kit in a disassembled form, according to an embodiment provided herein.
Figure 1:
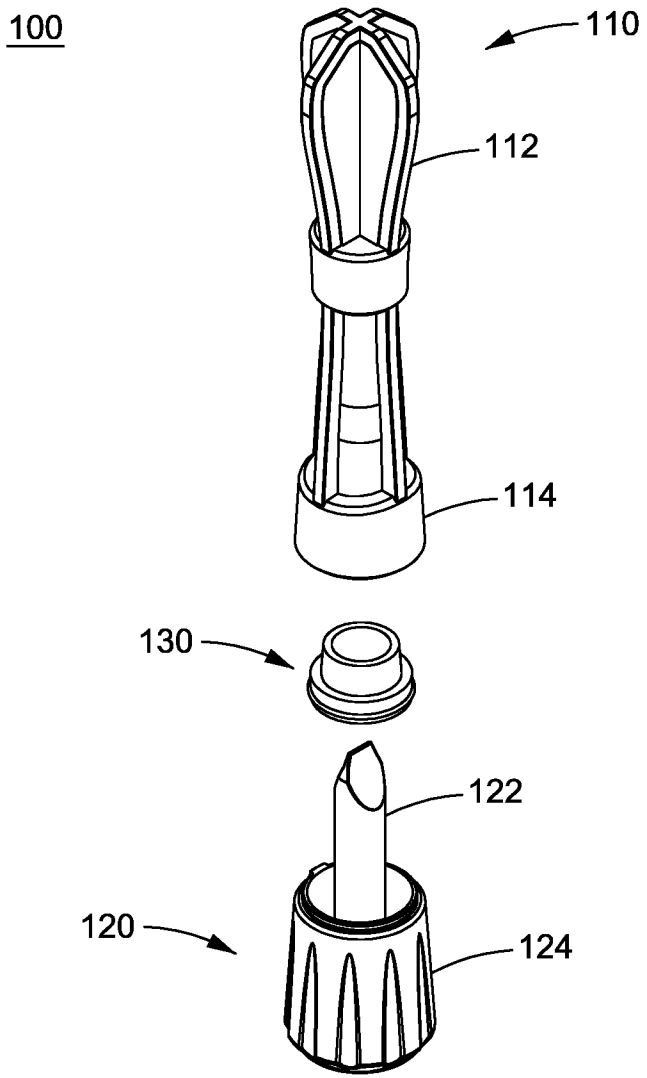
FIG. 1 is a perspective view of components of a toilet seat tightening kit in a disassembled form, according to an embodiment provided herein.

FIG. 1 is a perspective view and FIG. 2 a side view of components of a toilet seat tightening kit 100 in a disassembled form or state, according to an embodiment provided herein. As shown, the toilet seat tightening kit 100 includes a wrench 110, a screwdriver 120, and at least one washer 130. Although only one washer 130 is shown, a plurality of washers 130 may be provided with the toilet seat tightening kit 100 as described in detail herein.

As shown in FIGS. 1 and 2, the wrench 110 has a wrenching portion 114 and a handle 112 extending longitudinally outward from the wrenching portion 114. The screwdriver 120 comprises a shaft 122 and a handle 124.

Figure 3B:
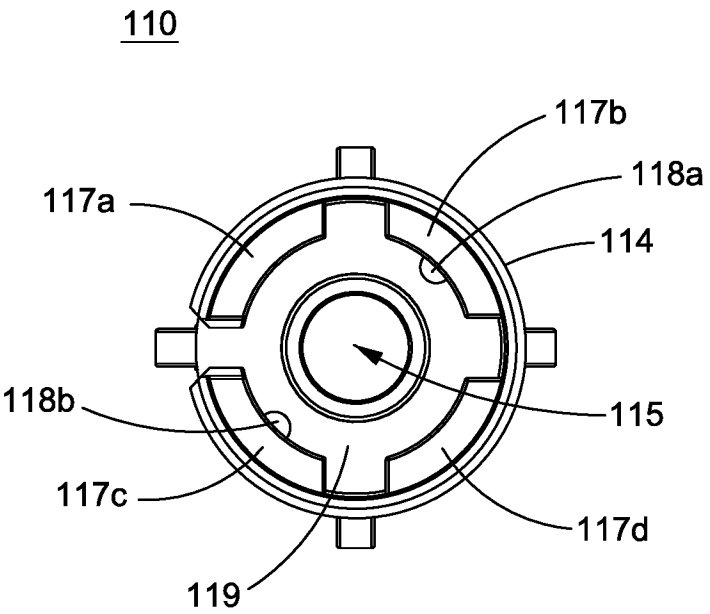
FIGS. 3A, 3B, and 3C are top perspective, bottom, and side cross-sectional views of a wrench, respectively, according to embodiments provided herein.
Figure 3A:
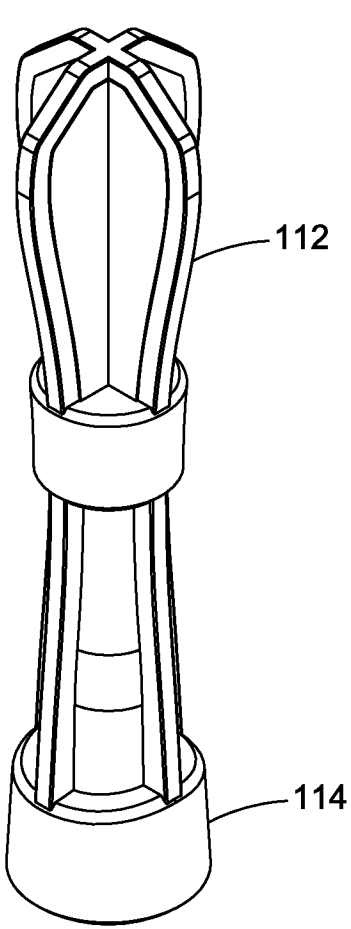
Figure 3C:
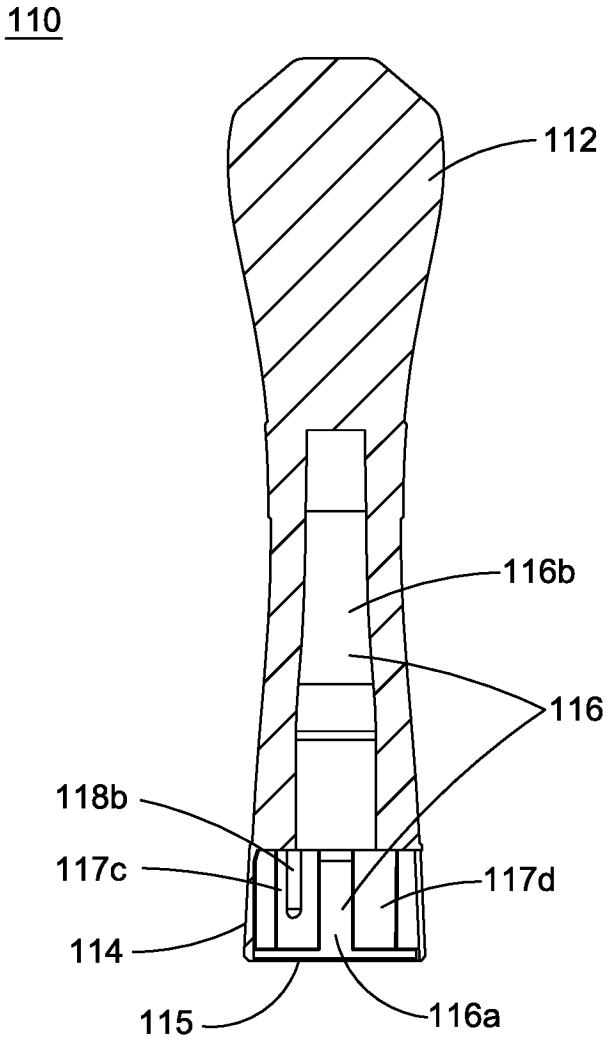

FIGS. 3A, 3B, and 3C provide additional details of the wrench 110, and include a top perspective, a bottom view, and a side cross-sectional view of the wrench 110, respectively. The view in FIG. 3B is from the bottom of the wrench 110, looking into the wrenching portion 114. As shown, there is an opening 115 which provides access to an interior cavity 116 formed within the wrench 110. In an embodiment, the interior cavity 116 is formed within a portion of the wrenching portion 114 of the wrench 110. In another embodiment, the interior cavity 116 may extend beyond the wrenching portion 114 into a portion of the handle 112. In yet another embodiment (not shown), the interior cavity 116 may be formed in the handle 112 with an opening at an end portion of the handle 112 for access into the interior cavity 116.

According to an embodiment, the interior cavity 116 comprises a first interior cavity 116*a* and a second interior cavity 116*b*. Both 116*a* and 116*b* are accessible via the opening 115, and the cavities 116*a* and 116*b* are connected to one another (see FIG. 3C). According to an embodiment, the diameter of the first interior cavity 116*a* is greater than that of the second interior cavity 116*b*. In another embodiment, the length of the second interior cavity 116*b* is greater than that of the first interior cavity 116*a*.

According to an embodiment, as shown in FIGS. 3B and 3C, the wrenching portion 114 includes one or more tabs 117 (shown are tabs 117*a*, 117*b*, 117*c*, and 117*d*) positioned inside an inner circumference of the first interior cavity 116*a*. Each of the tabs 117 may extend along a majority portion of the depth of the first interior cavity 116*a*, stopping at or near inner flat portion 119, which separates the first interior cavity 116*a* from the second interior cavity 116*b*. One or more of the tabs 117 may have grips 118 (shown are grips 118*a* and 118*b*) formed on an outer edge portion. The tabs 117, the grips 118, and the inner flat portion 119 of the first interior cavity 116*a* are the portions of the wrench 110 used to tighten a bolt for installing a toilet seat, as described below.

Figure 4:
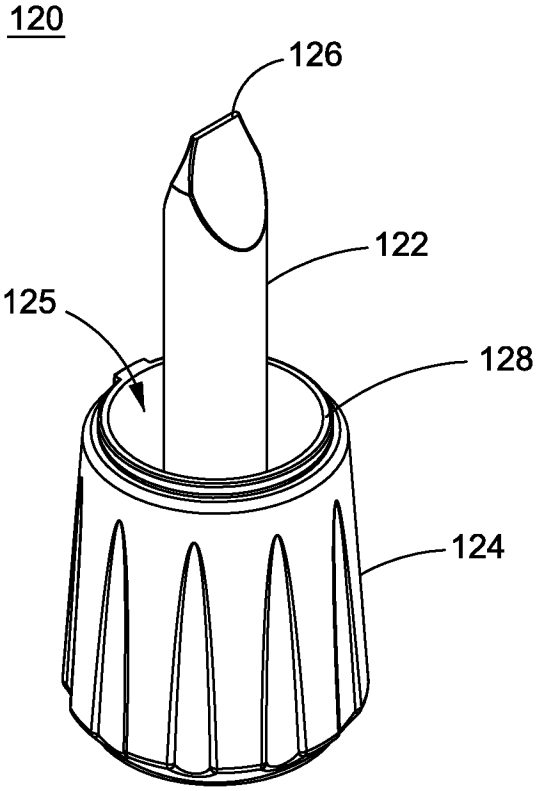
FIG. 4 is a perspective view of a screwdriver, according to embodiments provided herein.

FIG. 4 is a perspective view of the screwdriver 120, according to an embodiment. At the end of the shaft 122 is the tip 126. In an embodiment, the tip 126 is shaped to work with a hex cap head and a slotted head of a bolt. A mating end 128 of the handle 124 is provided. The mating end 128 may be an indented portion and may have one or more grooves or tabs for mating with the wrench 110 as described in detail below. As shown in FIG. 4, the handle portion 124 of the screwdriver 120 may have an opened portion 125 into which the shaft 122 extends.

Figure 5:
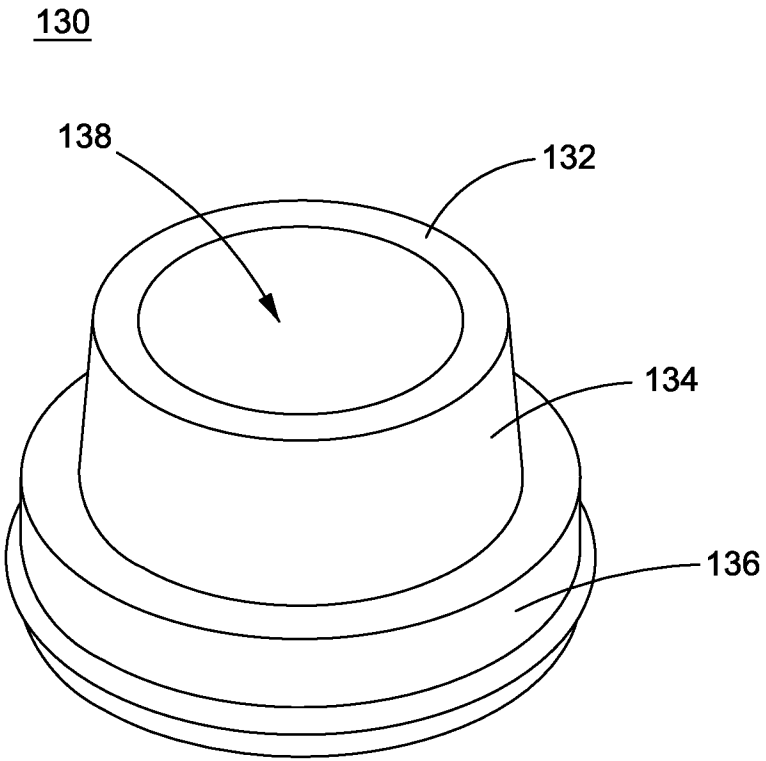
FIG. 5 is a perspective view of a washer, according to embodiments provided herein.

FIG. 5 is a perspective view of the washer 130, according to an embodiment. The washer 130 may be a standard washer, with a top edge 132, a top portion 134, a tabbed/grooved bottom portion 136, and an opening 138 extending throughout a central region of the washer 130.

Figure 7:
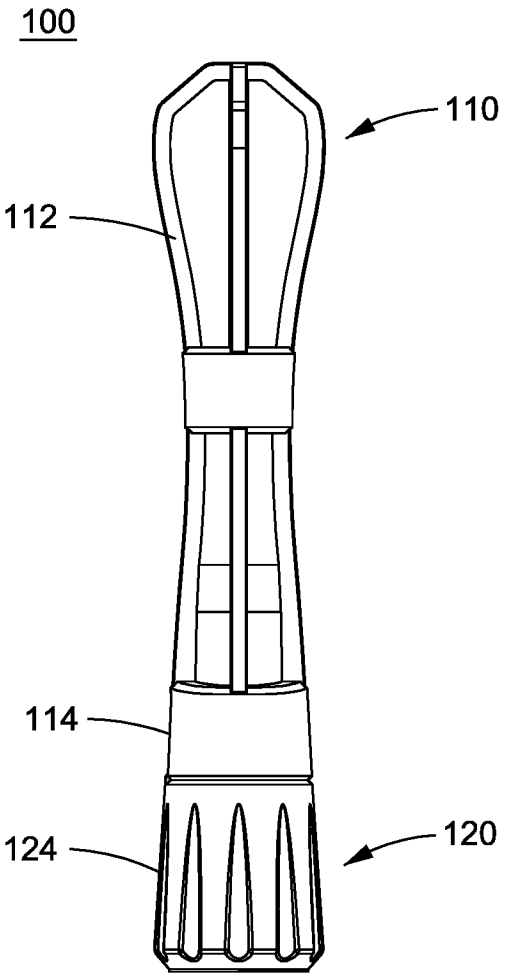
FIG. 7 is a side view of components of a toilet seat tightening kit in an assembled form, according to an embodiment provided herein.
Figure 6:
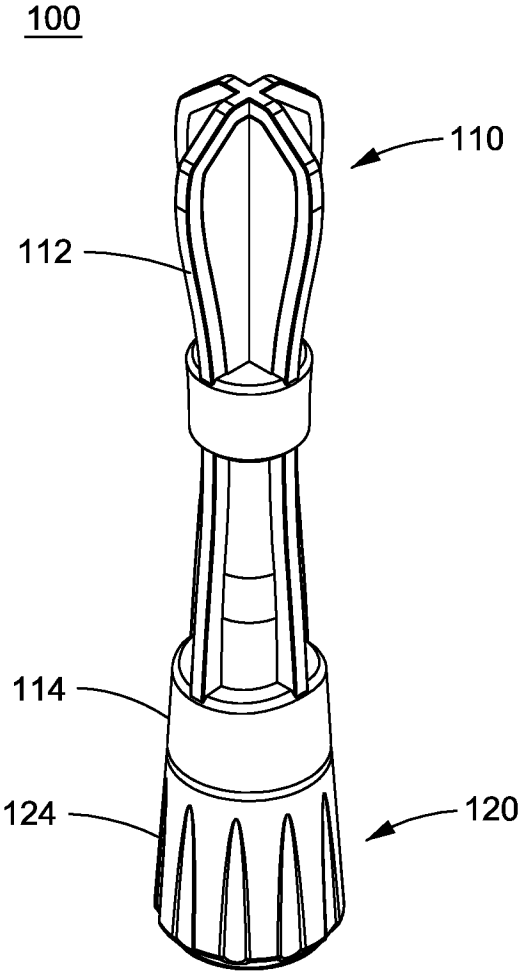
FIG. 6 is a perspective view of components of a toilet seat tightening kit in an assembled form, according to an embodiment provided herein.

FIG. 6 is a perspective view and FIG. 7 a side view of components of the toilet seat tightening kit 100 in an assembled form or state, according to embodiments provided herein. As shown, the screwdriver 120 and the wrench 110 are mated together with the wrench handle 112, the wrenching portion 114, and the screwdriver handle 124 exposed.

According to an embodiment, the one or more washers 130 are configured to fit over the shaft 122 of the screwdriver 120. In an embodiment, the washers 130 may extend into the opened portion 125 of the handle portion 124 of the screwdriver 120. The size and shape of the wrenching portion 114 of the wrench 110 is such that the shaft 122 of the screwdriver 120 fits within the interior cavity 116. The first interior cavity 116*a* is sized and shaped for the one or more washers 130 (placed over the shaft 122 of the screwdriver 120) to fit within, and the second interior cavity 116*b* is sized and shaped for a remaining portion of the shaft 122 of the screwdriver 120 to fit within. As previously noted, some of the washers 130 may be contained in the opened portion 125 of the screwdriver handle portion 124, while a portion of the washers 130 may be contained in the first interior cavity 116*a*. Moreover, the first interior cavity 116*a* is sized and shaped to hold a standard nut for tightly securing the nut, as described below when the toilet seat tightening kit 100 is in a disassembled form.

In an embodiment, the number of washers 130 that fit over the shaft 122 of the screwdriver 120 depends on the length of the shaft 122 and the size of the opened portion 125 of the handle 124. For a longer shaft 122, more washers 130 may be provided, and the dimensions of the wrench 110, including the cavities 116*a* and 116*b*, are adjusted to accommodate the longer length. In an embodiment, for example, four to six washers are provided, and the shaft 122 and the wrench 110 are sized accordingly.

According to embodiments herein, the screwdriver 120 and the wrench 110 are configured to mate with one another by the shaft 122 (with or without the washers 130) of the screwdriver 120 fitting into the interior cavity 116 via the opening 115 of the wrench 110 to form a unitary structure. According to an embodiment, the indented/grooved portion of the mating end 128 of the screwdriver 120 allows for the screwdriver 120 to snap fit into the cavity 116 via the opening 115 of the wrench 110. The mating end 128 may rest against the tabs 117 when the screwdriver 120 is inserted into the wrench 110. In an alternate embodiment (not shown), the mating end 128 of the screwdriver 120 may be screwed into the wrench 110 via grooves on each of the mating end 128 and the interior cavity 116.

To disassemble the toilet seat tightening kit 100, the handle 124 of the screwdriver 120 may be gripped and pulled away from the wrench 110. One or more of the washers 130 may be removed from the shaft 122 of the screwdriver 120.

Figure 8:
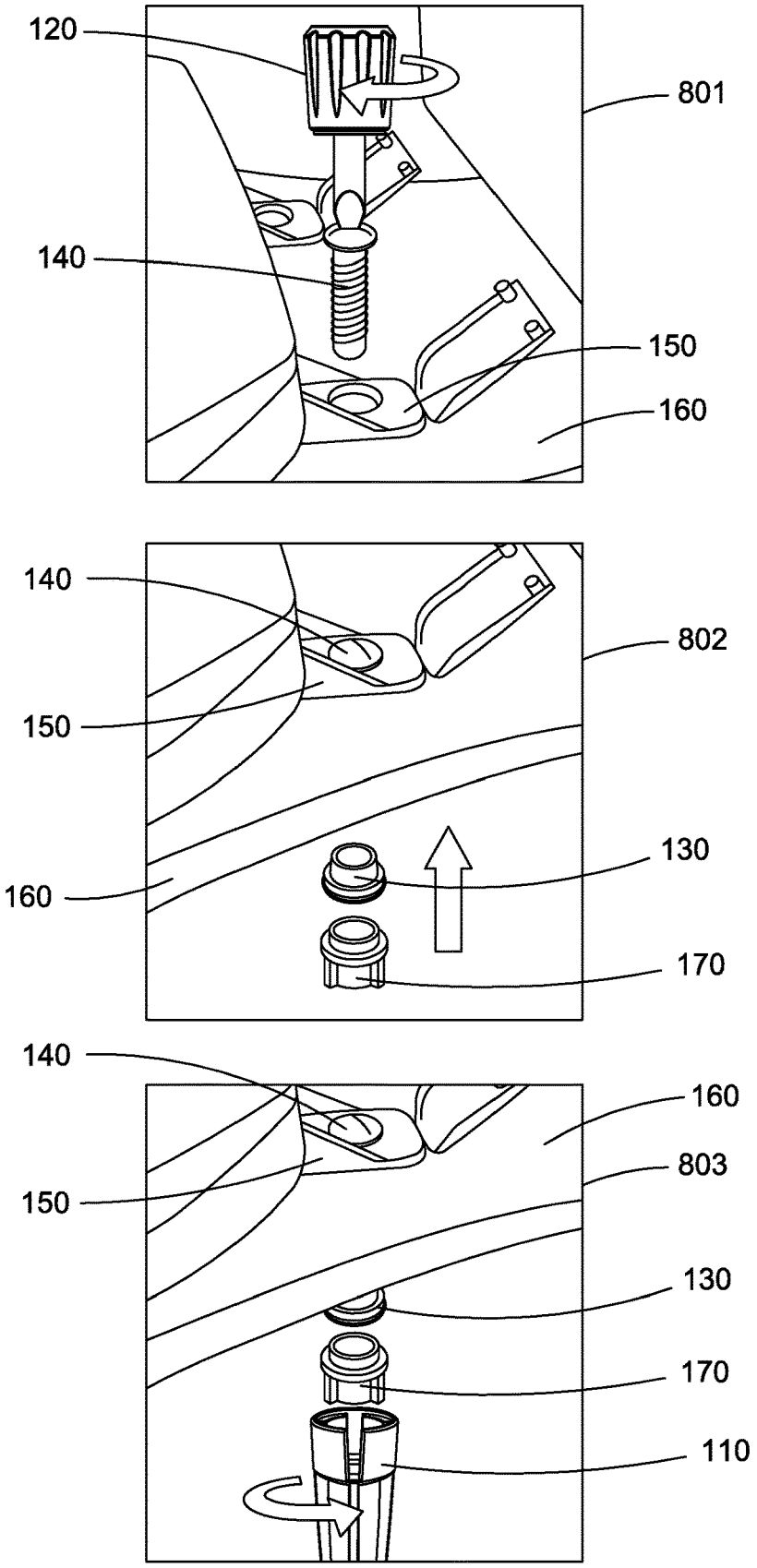
FIG. 8 is a diagram illustrating step by step details of utilizing a toilet seat tightening kit, according to an embodiment.

FIG. 8 is a diagram illustrating step by step details of utilizing a toilet seat tightening kit 100, according to an embodiment herein. At 801, the screwdriver 120 is utilized to tighten a bolt 140 in aligned holes of a toilet seat 150 and a toilet base 160. Once tightened, a top portion of the bolt 140 is positioned on a topside portion of the toilet seat 150 and the toilet base 160, and a bottom portion of the bolt 140 protrudes from an underside portion of the toilet base 160.

At 802, a washer 130 (removed from the shaft 122 of the screwdriver 120) and a nut 170 are placed on the on the bottom portion of the bolt 140 that is protruding from the underside portion of the toilet base 160.

At 803, the nut 170 is tightened with the wrenching portion 114 of the wrench 110 so that the washer 130 is tightly positioned between the nut 170 and the underside portion of the toilet base 160 on the bottom portion of the bolt 140.

Once the toilet seat 150 is securely installed on the toilet base 160, the toilet seat tightening kit 100 may be placed into its assembled form in which the washers 130 are placed on the shaft 122 of the screwdriver 120, and the screwdriver shaft 122 is inserted into the interior cavity 116 of the wrench 110.

The various components of the toilet seat tightening kit 100 may be made from any suitable plastic and/or rubber material. In an embodiment, the wrench 110 and the screwdriver 120 are formed of a hard plastic, and the one or more washers 130 are formed of a flexible rubber material. Other materials may be used.

In embodiments, the handle 112 of the wrench 110 and the handle portion 124 of the screwdriver 120 may be in any shape that provides a good grip for a user. Additional grips or protrusions may be provided.

The toilet seat tightening kit, according to embodiments herein, advantageously provides a unitary component for storage of components (i.e., a wrench, a screwdriver, and a plurality of washers) necessary for installing and tightening a toilet seat to a toilet base. Moreover, as the shaft of the screwdriver accommodates a plurality of washers, the toilet seat tightening kit can be used numerous times.

Although the present invention has been described with reference to exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that the appended claims be construed to cover all such equivalent variations as fall within the true spirit and scope of the invention.

We claim:

1. A toilet seat tightening kit comprising:

a screwdriver comprising a shaft;

one or more washers configured to fit over the shaft of the screwdriver; and a wrench comprising a wrenching portion and a handle extending longitudinally therefrom, wherein at least a portion of the wrench defines an interior cavity with an opening;

wherein the screwdriver and the wrench are configured to mate with one another, while the one or more washers are positioned on the shaft of the screwdriver, by the shaft of the screwdriver fitting into the interior cavity via the opening of the wrench to form a unitary structure.

2. The toilet seat tightening kit of claim 1, wherein the interior cavity comprises a first interior cavity and a second interior cavity, wherein the first interior cavity is sized and shaped for the one or more washers to fit within, and wherein the second interior cavity is sized and shaped for the shaft of the screwdriver to fit within.

3. The toilet seat tightening kit of claim 1, wherein the screwdriver snap-fits into the interior cavity of the wrench.

4. The toilet seat tightening kit of claim 1, wherein the screwdriver further comprises a handle portion connected to and extending longitudinally from the shaft, wherein the handle portion extends outward from the opening of the wrench when the screwdriver and the wrench are mated to form the unitary structure.

5. The toilet seat tightening kit of claim 1, wherein, in an assembled form, the screwdriver and the wrench mate with one another to form the unitary structure;

wherein, in a disassembled form, the screwdriver is configured to tighten a bolt in aligned holes of a toilet seat and a toilet base; and wherein, in the disassembled form, the wrench is configured to tighten a nut on a portion of the bolt protruding from an underside portion of the toilet base so that one of the one or more washers is tightly positioned between the nut and the underside portion of the toilet base.

6. A method of tightening a toilet seat, the method comprising:

providing a toilet seat tightening kit comprising:

a screwdriver comprising a shaft;

one or more washers configured to fit over the shaft of the screwdriver; and a wrench comprising a wrenching portion and a handle extending longitudinally therefrom, wherein at least a portion of the wrench defines an interior cavity with an opening;

wherein, in an assembled form, the screwdriver and the wrench are configured to mate with one another, while the one or more washers are positioned on the shaft of the screwdriver, by the shaft of the screwdriver fitting into the interior cavity via the opening of the wrench to form a unitary structure;

tightening a bolt in aligned holes of a toilet seat and a toilet base with the screwdriver so that a top portion of the bolt is positioned on a topside portion of the toilet seat and the toilet base and a bottom portion of the bolt protrudes from an underside portion of the toilet base;

sequentially placing one of the one or more washers and a nut on the bottom portion of the bolt; and tightening the nut with the wrenching portion of the wrench so that the one of the one or more washers is positioned between the nut and the underside portion of the toilet base on the bottom portion of the bolt.

7. The method of claim 6, wherein the interior cavity comprises a first interior cavity and a second interior cavity, wherein the first interior cavity is sized and shaped for the one or more washers to fit within, and wherein the second interior cavity is sized and shaped for the shaft of the screwdriver to fit within.

8. The method of claim 7, wherein the first interior cavity is sized and shaped to hold the nut for tightly securing the nut.

9. The method of claim 6, wherein the screwdriver snap-fits into the interior cavity of the wrench.

10. The method of claim 6, wherein the screwdriver further comprises a handle portion connected to and extending longitudinally from the shaft, wherein the handle portion extends outward from the opening of the wrench when the screwdriver and the wrench are mated to form the unitary structure.

11. A toilet seat tightening kit comprising:

a screwdriver comprising a shaft;

one or more washers configured to fit over the shaft of the screwdriver; and a wrench comprising a wrenching portion and a handle extending longitudinally therefrom, wherein at least a portion of the wrench defines an interior cavity with an opening;

wherein the screwdriver and the wrench are configured to mate with one another by the shaft of the screwdriver snap-fitting into the interior cavity via the opening of the wrench to form a unitary structure.

12. The toilet seat tightening kit of claim 11, wherein the interior cavity comprises a first interior cavity and a second interior cavity, wherein the first interior cavity is sized and shaped for the one or more washers to fit within, and wherein the second interior cavity is sized and shaped for the shaft of the screwdriver to fit within.

13. The toilet seat tightening kit of claim 11, wherein the screwdriver further comprises a handle portion connected to and extending longitudinally from the shaft, wherein the handle portion extends outward from the opening of the wrench when the screwdriver and the wrench are mated to form the unitary structure.

14. The toilet seat tightening kit of claim 11, wherein, in an assembled form, the screwdriver and the wrench mate with one another to form the unitary structure;

wherein, in a disassembled form, the screwdriver is configured to tighten a bolt in aligned holes of a toilet seat and a toilet base; and wherein, in the disassembled form, the wrench is configured to tighten a nut on a portion of the bolt protruding from an underside portion of the toilet base so that one of the one or more washers is tightly positioned between the nut and the underside portion of the toilet base.

15. A method of tightening a toilet seat, the method comprising:

providing a toilet seat tightening kit comprising:

a screwdriver comprising a shaft;

one or more washers configured to fit over the shaft of the screwdriver; and a wrench comprising a wrenching portion and a handle extending longitudinally therefrom, wherein at least a portion of the wrench defines an interior cavity with an opening;

wherein, in an assembled form, the screwdriver and the wrench are configured to mate with one another by the shaft of the screwdriver snap-fitting into the interior cavity via the opening of the wrench to form a unitary structure;

tightening a bolt in aligned holes of a toilet seat and a toilet base with the screwdriver so that a top portion of the bolt is positioned on a topside portion of the toilet seat and the toilet base and a bottom portion of the bolt protrudes from an underside portion of the toilet base;

sequentially placing one of the one or more washers and a nut on the bottom portion of the bolt; and tightening the nut with the wrenching portion of the wrench so that the one of the one or more washers is positioned between the nut and the underside portion of the toilet base on the bottom portion of the bolt.

16. The method of claim 15, wherein the interior cavity comprises a first interior cavity and a second interior cavity, wherein the first interior cavity is sized and shaped for the one or more washers to fit within, and wherein the second interior cavity is sized and shaped for the shaft of the screwdriver to fit within.

17. The method of claim 16, wherein the first interior cavity is sized and shaped to hold the nut for tightly securing the nut.

18. The method of claim 15, wherein the screwdriver further comprises a handle portion connected to and extending longitudinally from the shaft, wherein the handle portion extends outward from the opening of the wrench when the screwdriver and the wrench are mated to form the unitary structure.

* * * * *